United States Patent [19]

Olsen

[11] 4,001,810

[45] Jan. 4, 1977

[54] SEQUENCE REVERSING BORDER LIGHT DISPLAY

[75] Inventor: Roy Olsen, Rosemead, Calif.

[73] Assignee: Superior Outdoor Display, Inc., Long Beach, Calif.

[22] Filed: Dec. 18, 1975

[21] Appl. No.: 641,838

[52] U.S. Cl. ..... 340/338; 40/106.52; 315/323; 340/331

[51] Int. Cl.[2] ..... G08B 5/36

[58] Field of Search ..... 340/331, 338; 40/125 L, 40/106.52; 315/317, 323

[56] References Cited

UNITED STATES PATENTS

| | | | |
|---|---|---|---|
| 502,007 | /1893 | McCormick | 340/338 |
| 1,913,504 | 6/1933 | Nachumsohn | 315/323 X |
| 2,125,668 | 8/1938 | Chase | 340/331 |
| 3,781,604 | 12/1973 | Scarpino | 315/323 X |
| 3,838,412 | 9/1974 | Jones et al. | 340/334 |

*Primary Examiner*—David L. Trafton
*Attorney, Agent, or Firm*—Flam & Flam

[57] ABSTRACT

A series of flashing lights arranged in a line or circle appear as a group to move or rotate by properly timing the OFF or periods of the lights. The lights are divided into three interpositioned groups for separate control. The groups progressively go dark in one sequence and then in the reverse sequence by the aid of a simple cam clock means that periodically switches the cadence of only one of the groups to cause it alternately closely to lead or follow one of the other groups. No mechanical reversals of clock means occurs.

2 Claims, 4 Drawing Figures

SEQUENCE REVERSING BORDER LIGHT DISPLAY

FIELD OF INVENTION

This invention relates to outdoor illuminated flashing lights intended to catch the attention of passers by. More particularly this invention relates to illuminated displays having a line or border of lights that turn on and off in cadence in order to create the illusion of motion or rotation.

BACKGROUND OF INVENTION

Reversal of the rotation pattern of a border light system has been achieved in the past by physically reversing a cam clock means that controls the cadence of the light groups. Such mechanisms, operating as they do in a non-uniform manner, tend to be complicated and short lived. Various digital circuits are conceivable for control of solid state switching devices or the like. Yet nothing has proved simpler, more economical and reliable for turning groups of lights on an off than a rotary cam and follower arrangement. The primary object of the present invention is to provide a simple cam clock means of this character that will periodically reverse the rotation or movement pattern of the lights while the cam clock means is driven continuously by a fractional horsepower motor.

SUMMARY OF THE INVENTION

The foregoing object is achieved by operating two of the three groups in about 180° out of phase relationship while the third group is operated so as alternately to lead and follow the pattern of the other two. One cam has equally spaced lobes and operates the two out of phase light groups. A second cam has two sets of correspondingly spaced lobes, the sets being shifted slightly so that the shift in cadence takes place twice each cycle to cause the reversal of apparent movement.

BRIEF DESCRIPTION OF THE DRAWINGS

A detailed description of the invention will be made with reference to the accompanying drawings wherein like numerals designate corresponding parts in the several figures.

DETAILED DESCRIPTION OF PREFERRED EMBODIMENT

The following detailed description is of the best presently contemplated mode of carrying out the invention. This description is not to be taken in a limiting sense, but is made merely for purposes of illustrating the general principles of the invention since the scope of the invention is best defined by the appended claims.

Figure 1:
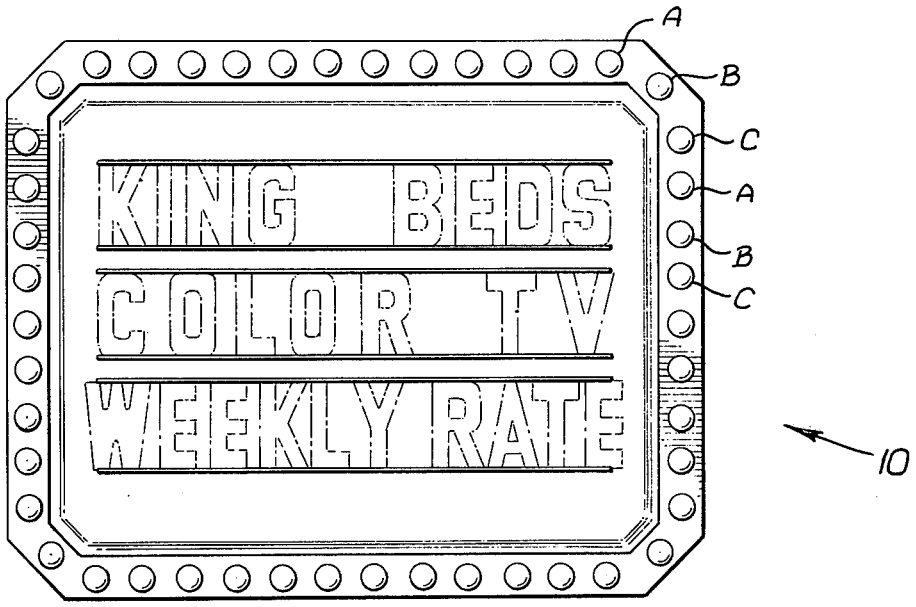
FIG. 1 is an elevational view of a typical outdoor illuminated display having a border of lights to produce a rotating pattern.
Figure 2:
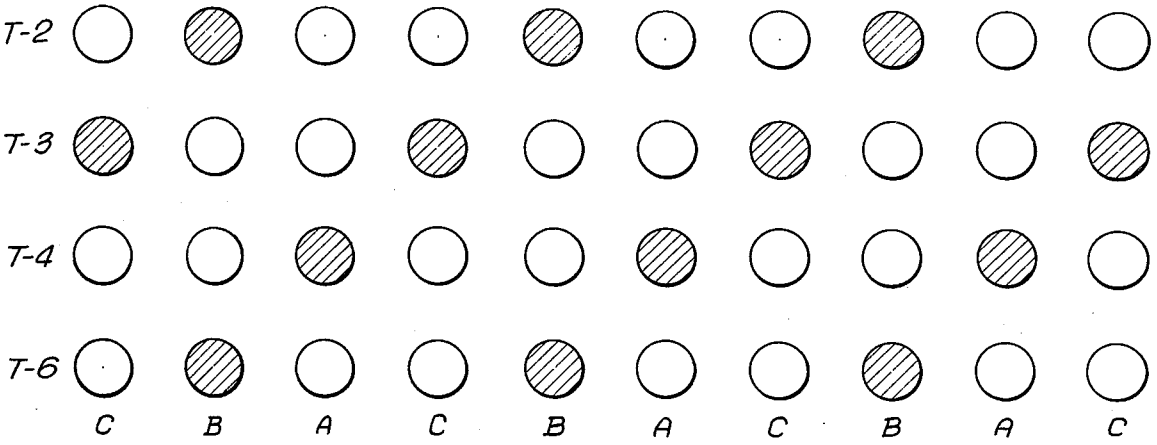
FIG. 2 is a diagrammatic view illustrating the lighting sequence whereby an apparent motion to the left is achieved.

The outdoor illuminated display 10 shown in FIG. 1 is bordered by a series of lights. These lights are divided into three interpositioned groups A, B and C for control of energization. The light groups A, B and C are deenergized in sequence in order to create the illusion of a moving or rotating pattern. In FIG. 2, the same lights are shown at four successive times. At time T-2, lights of group B are deenergized; at time T-3, lights of group C are deenergized; at time T-4, lights of group A are deenergized. The cycle repeats at time T-6 with lights of group B being deenergized. Thus the dark pattern is BCABCABCABCA. The light pattern thus appears to be moving to the left as viewed in FIG. 2.

Figure 4:
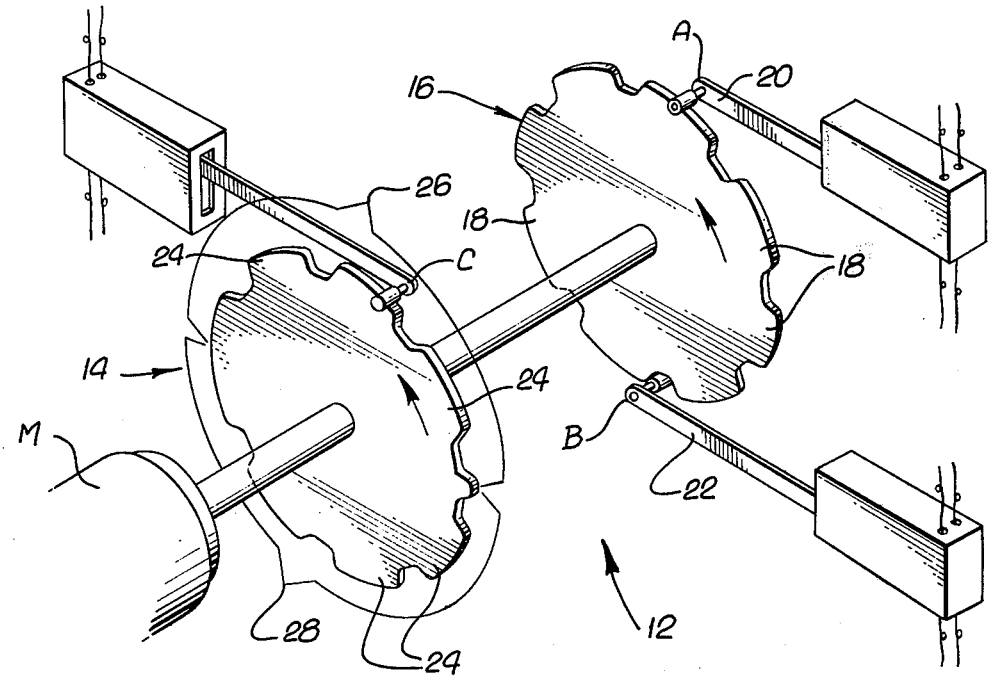
FIG. 4 is a diagrammatic view illustrating the two cams used in producing the timing illustrated in FIG. 3.
Figure 3:
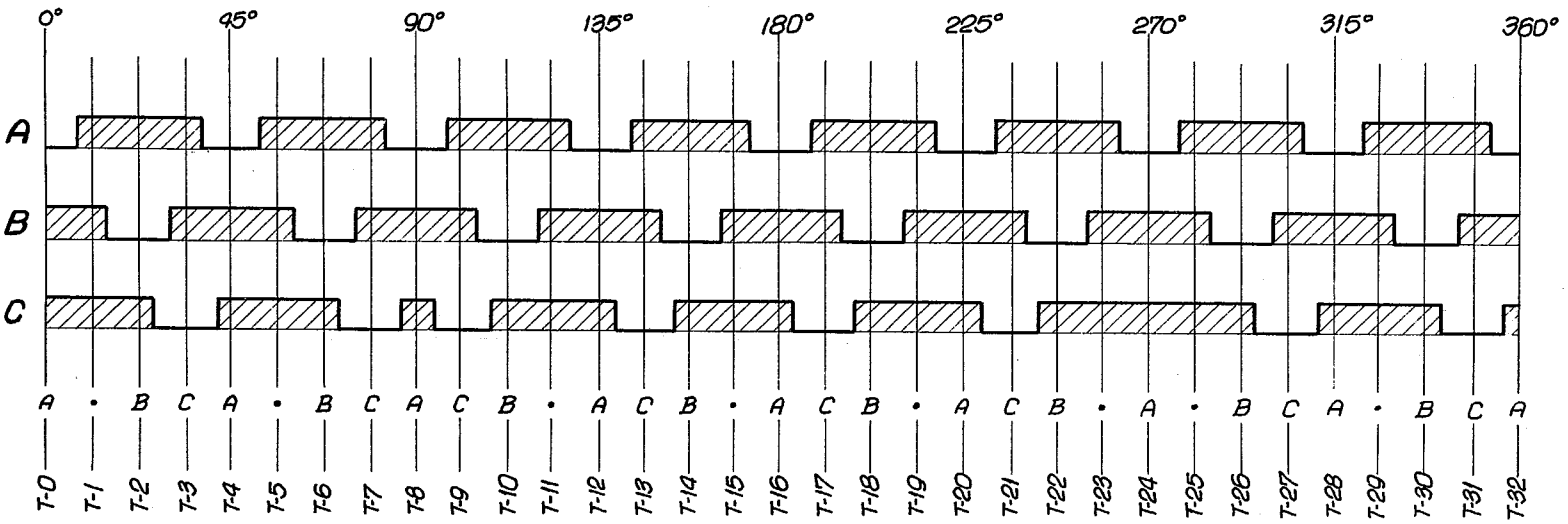
FIG. 3 is a diagrammatic view illustrating the timing of the three groups of lights, the ON and OFF characteristics of the groups being plotted as a function of time.

In order to reverse the direction of apparent movement, the pattern must be BACBACBAC . . . instead of BCABCABCA. A cam mechanism 12 (FIG. 4) that opens and closes switches for the three groups of switches in such manner as to achieve this result. In practice, the lighting patterns have a slightly irregular or syncopated movement. Thus, the dark patterns are actually BCA.BCA.BCA.BCA . . . and ACB.ACB-.ACB.ACB . . . This pattern is depicted in FIG. 3 in which the ON and OFF characteristics of the light groups are plotted as a function of time. Times T-2, T-3, T-4 and T-6 previously described are indicated in FIG. 3. In order to achieve the change in apparent direction of movement, the light groups A and B as shown in FIG. 3 have uniformly spaced and equal numbers of OFF periods per cycle, eight in this instance. But the OFF periods of groups A and B are 180° out of phase. For half of the cycle, namely at times T-9, T-13, T-17 and T-21, the OFF periods for the third group C just follows the OFF periods for group A and just leads the OFF periods for group B. Thus the pattern is ACB-.ACB.ACB.ACB. and apparent rotation in one direction is achieved. However, for the other half of the cycle, namely at times T-27, T-31, T-3 and T-7, the OFF periods for the third group now just follows that of group B and just lead that of group A. Thus the pattern is BCA.BCA.BCA.BCA. reversal of the apparent direction takes place.

In order to achieve the OFF patterns depicted in FIG. 3, two cams 14 and 16 are provided that are both driven by a fractional horsepower motor M at any suitable or adjusted speed. The cam 16 has eight equally spaced cam lobes 18 that cooperate with two switch arms 20 and 22. The switch arms 20 and 22 control energization circuits for the lamp groups A and B respectively. The arms 20 and 22 are positioned so that the OFF periods of the groups A and B are out of phase by substantially 180°. The cam 14 also has eight lobes 24 divided into two sets of four each as indicated by the brackets 26 and 28. The lobes of each set are equally spaced in an amount corresponding to that of the lobes 18 of the companion cam. However, the sets are shifted so as to achieve the pattern depicted in FIG. 3. Thus at one of the two places between adjacent sets, the first OFF period of one set follows 28 quickly the last OFF period of the other set 26, and as indicated at times T-7, T-8 and T-9 in FIG. 3. At the other of the two places between adjacent sets, the first OFF period of the second set 26 lags the last OFF period of the one set 28, and as indicated at times T-21 and T-27 in FIG. 3. Obviously the different cam configurations can be provided as long as there are sets of cam lobes or time positions that are shifted in order to change the cadence of one of the light groups. The individual lights designated as A, B or C may themselves constitute a plurality of elements in any suitable array. The number of elements need not be uniform.

Intending to claim all novel, useful and unobvious features shown or described, I make the following claims:

1. In an illuminated display:

a. a series of lights arrayed in a line;

b. three interruptible circuit means segregating the lights into three interpositioned groups;

c. first timing means for cyclically operating two of the circuit means so that the OFF periods of the corresponding groups are substantially out of phase;

d. second timing means for operating the third circuit means so that the lights of the third group have two cyclic modes, in one of which the OFF periods of said third group lead the OFF periods of said first group and follow the OFF periods of said second group and in the other of which the OFF periods of said third group follow the OFF periods of said first group and lead the OFF periods of said second group; and e. common drive means for operating said timing means in synchronism whereby the apparent direction of movement of said series of lights cyclically changes notwithstanding uniform movement of said common drive means.

2. The combination as set forth in claim 1 in which said first timing means includes a cam with equally and uniformly spaced cam lobes, said second timing means including a second cam having alternate sets of cam lobes, the sets being successively closer and farther from each other.

* * * * *